US008006771B2

(12) United States Patent
Green et al.

(10) Patent No.: US 8,006,771 B2
(45) Date of Patent: Aug. 30, 2011

(54) METHODS FOR EXPANDING TUBULAR STRINGS AND ISOLATING SUBTERRANEAN ZONES

(75) Inventors: Annabel Green, Aberdeen (GB); Lev Ring, Houston, TX (US); Colin McHardy, Aberdeen (GB); Simon Harrall, Houston, TX (US); Gary Johnston, Aberdeenshire (GB); Neil A. A. Simpson, Aberdeen (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/467,103

(22) Filed: May 15, 2009

(65) Prior Publication Data

US 2009/0223680 A1 Sep. 10, 2009

Related U.S. Application Data

(60) Continuation of application No. 11/865,850, filed on Oct. 2, 2007, now Pat. No. 7,543,637, which is a division of application No. 10/954,866, filed on Sep. 30, 2004, now Pat. No. 7,275,602, which is a continuation-in-part of application No. 10/750,208, filed on Dec. 31, 2003, now Pat. No. 7,124,826, which is a continuation of application No. 10/217,833, filed on Aug. 13, 2002, now Pat. No. 6,702,030, which is a continuation of application No. 09/469,690, filed on Dec. 22, 1999, now Pat. No. 6,457,532, said application No. 10/954,866 is a continuation-in-part of application No. 10/886,513, filed on Jul. 7, 2004, now Pat. No. 7,234,532, and a continuation-in-part of application No. 10/809,042, filed on Mar. 25, 2004, which is a continuation-in-part of application No. 10/618,419, filed on Jul. 11, 2003, now Pat. No. 7,575,060.

(51) Int. Cl.
*E21B 23/02* (2006.01)

(52) U.S. Cl. ..... 166/384; 166/207

(58) Field of Classification Search ..... 166/207, 166/380, 384
See application file for complete search history.

(56) References Cited

U.S. PATENT DOCUMENTS 3,669,190 A 6/1972 Sizer et al.
(Continued)

FOREIGN PATENT DOCUMENTS

CA 2 413 244 5/2003
(Continued)

OTHER PUBLICATIONS

GB Examination Report for GB0519312.3 dated Nov. 13, 2009.
(Continued)

*Primary Examiner* — William P Neuder
(74) *Attorney, Agent, or Firm* — Patterson & Sheridan, LLP

(57) ABSTRACT

Methods relate to tubulars that may be part of a tubular string for isolating one or more zones within a wellbore. In one embodiment, the tubular string includes a first expandable zone isolation unit disposed on a first side of a zone to be isolated, a second expandable zone isolation unit disposed on a second side of the zone to be isolated, and a perforated tubular disposed in fluid communication with a producing zone. The tubular string may be expanded using an expansion assembly having a first expander for expanding the first and second expandable zone isolation units and a second expander for expanding the at least one perforated tubular. Tags or markers along the tubular string may indicate locations where expansion is desired such that connections or connectors between joints are not expanded.

37 Claims, 6 Drawing Sheets

U.S. PATENT DOCUMENTS

| | | | | |
|---|---|---|---|---|
| 3,785,193 | A | 1/1974 | Kinley et al. | |
| 5,706,896 | A | 1/1998 | Tubel et al. | |
| 5,890,540 | A | 4/1999 | Pia et al. | |
| 5,901,796 | A | 5/1999 | McDonald | |
| 5,918,677 | A | 7/1999 | Head | |
| 5,979,572 | A | 11/1999 | Boyd et al. | |
| 6,102,126 | A | 8/2000 | Huber et al. | |
| 6,223,823 | B1 | 5/2001 | Head | |
| 6,279,657 | B1 | 8/2001 | Carmichael et al. | |
| 6,325,148 | B1 | 12/2001 | Trahan et al. | |
| 6,328,113 | B1 | 12/2001 | Cook | |
| 6,333,699 | B1 | 12/2001 | Zierolf | |
| 6,333,700 | B1 | 12/2001 | Thomeer et al. | |
| 6,378,612 | B1 | 4/2002 | Churchill | |
| 6,457,532 | B1 | 10/2002 | Simpson | |
| 6,536,524 | B1 | 3/2003 | Snider | |
| 6,598,678 | B1 | 7/2003 | Simpson et al. | |
| 6,634,431 | B2 | 10/2003 | Cook et al. | |
| 6,702,030 | B2 | 3/2004 | Simpson | |
| 6,712,154 | B2 | 3/2004 | Cook et al. | |
| 6,725,937 | B1 | 4/2004 | McHardy | |
| 6,742,598 | B2 | 6/2004 | Whitelaw et al. | |
| 6,759,968 | B2 | 7/2004 | Zierolf | |
| 6,820,687 | B2 | 11/2004 | Maguire et al. | |
| 6,820,697 | B1 | 11/2004 | Churchill | |
| 6,860,329 | B1 | 3/2005 | Oosterling | |
| 7,004,264 | B2 | 2/2006 | Simpson et al. | |
| 7,017,670 | B2 | 3/2006 | Hazel et al. | |
| 7,121,351 | B2 | 10/2006 | Luke et al. | |
| 7,124,826 | B2 | 10/2006 | Simpson | |
| 7,152,684 | B2 | 12/2006 | Harrall et al. | |
| 7,168,493 | B2 | 1/2007 | Eddison | |
| 7,174,764 | B2 | 2/2007 | Oosterling et al. | |
| 7,181,821 | B2 | 2/2007 | Anderson et al. | |
| 7,234,532 | B2 | 6/2007 | Metcalfe et al. | |
| 7,243,722 | B2 | 7/2007 | Oosterling et al. | |
| 7,275,602 | B2 | 10/2007 | Green et al. | |
| 7,299,880 | B2 | 11/2007 | Logiudice et al. | |
| 7,318,478 | B2 | 1/2008 | Royer | |
| 7,383,881 | B2 | 6/2008 | Telfer | |
| 7,385,523 | B2 | 6/2008 | Thomeer et al. | |
| 7,441,607 | B2 | 10/2008 | Telfer | |
| 7,474,221 | B2 | 1/2009 | Den Boer et al. | |
| 7,497,255 | B2 * | 3/2009 | Filippov et al. | 166/207 |
| 7,575,060 | B2 | 8/2009 | Hillis et al. | |
| 7,766,084 | B2 | 8/2010 | Churchill | |
| 7,766,086 | B2 | 8/2010 | Mondelli et al. | |
| 2004/0173360 | A1 | 9/2004 | Harrall et al. | |
| 2005/0005668 | A1 | 1/2005 | Duggan et al. | |
| 2005/0098324 | A1 * | 5/2005 | Gano | 166/384 |

FOREIGN PATENT DOCUMENTS

| | | |
|---|---|---|
| GB | 2 398 317 | 8/2004 |
| GB | 2 402 689 | 12/2004 |
| GB | 2 408 278 | 5/2005 |
| GB | 2 409 216 | 6/2005 |
| GB | 2428717 | 2/2007 |
| RU | 2064357 | 7/1996 |
| WO | WO 95/03476 | 2/1995 |

OTHER PUBLICATIONS

U.K. Search and Examination Report, Application No. GB0519312.3, dated Jul. 9, 2009.

GB Search Report for Application No. GB0519312.3 dated Nov. 30, 2005.

Canadian Office Action for Application No. 2,519,325 dated Feb. 26, 2007.

* cited by examiner

METHODS FOR EXPANDING TUBULAR STRINGS AND ISOLATING SUBTERRANEAN ZONES

CROSS-REFERENCE TO RELATED APPLICATIONS

This application is a continuation of U.S. patent application Ser. No. 11/865,850, filed Oct. 2, 2007, now U.S. Pat. No. 7,543,637 which is a divisional of U.S. patent application Ser. No. 10/954,866, filed Sep. 30, 2004, now U.S. Pat. No. 7,275,602, which is a continuation-in-part of U.S. patent application Ser. No. 10/750,208, filed Dec. 31, 2003, now U.S. Pat. No. 7,124,826, which is a continuation of U.S. patent application Ser. No. 10/217,833, filed Aug. 13, 2002, now U.S. Pat. No. 6,702,030, which is a continuation of U.S. patent application Ser. No. 09/469,690, filed Dec. 22, 1999, now U.S. Pat. No. 6,457,532, which claims benefit of Great Britain applications GB9828234, GB9900835, GB9923783 and GB9924189; and said Ser. No. 10/954,866 application is a continuation-in-part of U.S. patent application Ser. No. 10/618,419, filed Jul. 11, 2003, now U.S. Pat. No. 7,575,060 which claims benefit of Great Britain application GB0216074.5; and said 10/954,866 application is a continuation-in-part of U.S. patent application Ser. No. 10/809,042, filed Mar. 25, 2004, which claims benefit of Great Britain applications GB0306774.1, GB0312278.5 and GB0316050.4, and is a continuation-in-part of U.S. patent application Ser. No. 10/618,419, filed Jul. 11, 2003, now U.S. Pat. No. 7,575,060 which claims benefit of Great Britain patent application GB0216074.5; and said 10/954,866 application is a continuation-in-part of U.S. patent application Ser. No. 10/886,513, filed Jul. 7, 2004, now U.S. Pat. No. 7,234,532, which claims benefit of Great Britain application GB0316048.8. Each of the aforementioned related patent applications is herein incorporated by reference.

BACKGROUND OF THE INVENTION

1. Field of the Invention

Embodiments of the invention generally relate to expanding tubulars and well completion. More particularly, embodiments of the invention relate to methods and apparatus for isolating a subterranean zone.

2. Description of the Related Art

Hydrocarbon wells typically begin by drilling a borehole from the earth's surface through subterranean formations to a selected depth in order to intersect one or more hydrocarbon bearing formations. Steel casing lines the borehole, and an annular area between the casing and the borehole is filled with cement to further support and form the wellbore. Flow of hydrocarbons or any other fluid into the wellbore occurs at locations along portions of the casing having openings therein, along a perforated tubular or a screen or along any portions of the wellbore left open or unlined with casing.

The wellbore typically traverses several zones within the subterranean formation. However, some of the zones may not produce hydrocarbons or may produce hydrocarbons at different reservoir pressures. For example, some zones produce water that contaminates the production of hydrocarbons from other zones and requires costly removal from the produced hydrocarbons. Thus, it is often necessary to isolate subterranean zones from one another in order to facilitate the production of hydrocarbons.

Prior zonal isolation assemblies are complex, expensive, and undependable and often require multiple trips into the well at significant time and expense. Prior methods and systems for isolating subterranean zones include the use of packers and/or plugs set within the casing, around the casing or in an open hole section to prevent fluid communication via the casing or the borehole from one zone to another. One method for isolating zones involves expanding a series of solid and slotted casing in the wellbore such that seals on the outside of the solid casing prevent the passage of fluids within the annulus in order to isolate a zone traversed by the solid casing.

However, expansion of solid casing can alter an inner seating surface within the solid casing that is used to isolate the zone, thereby preventing the use of conventional packers that seat inside the solid casing during subsequent completion operations. Further, expanding tubular connections downhole sometimes proves to be problematic due to changes in geometry of the connection during expansion and rotation across the connection caused by use of a rotary expansion tool. Additionally, the type of expander tool suitable for expanding solid tubulars may not be desirable for expanding a sand screen into supporting contact with a surrounding formation. For example, expanding sand screen requires use of significantly less force than when expanding solid tubulars in order to prevent damage to the sand screen. Furthermore, expanding long sections of solid tubulars is time consuming and can be complicated by a short operational life of some expander tools. In addition, factors such as stretching of a running string that an expander tool is mounted on makes it difficult or impossible to accurately determine an exact location downhole for expansion of only a desired portion of selected tubular members.

There exists a need for apparatus and methods for reliably and inexpensively isolating subterranean zones by selectively expanding an assembly of tubulars. Further, a need exists for a zonal isolation assembly that provides a seat for conventional packers used in completion operations.

SUMMARY OF THE INVENTION

Embodiments of the invention generally relate to methods and apparatus for expanding tubulars, which may be part of a tubular string for isolating one or more zones within a wellbore. In one embodiment, the tubular string includes a first expandable zone isolation unit disposed on a first side of a zone to be isolated, a second expandable zone isolation unit disposed on a second side of the zone to be isolated, and a perforated tubular disposed in fluid communication with a producing zone. The tubular string may be expanded using an expansion assembly having a first expander for expanding the first and second expandable zone isolation units and a second expander for expanding the at least one perforated tubular. Tags or markers along the tubular string may indicate locations where expansion is desired such that connections or connectors between joints are not expanded.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention generally relate to a system for expanding tubulars, which may be part of a tubular string for isolating one or more zones within a wellbore. The tubular string may be located within cased hole, open hole or both cased and open hole portions of the wellbore. Furthermore, embodiments of the system may be used in other applications including pipelines and other tubulars such as found in power plants, chemical manufacturing facilities and chemical catalyst beds.

Figure 1:
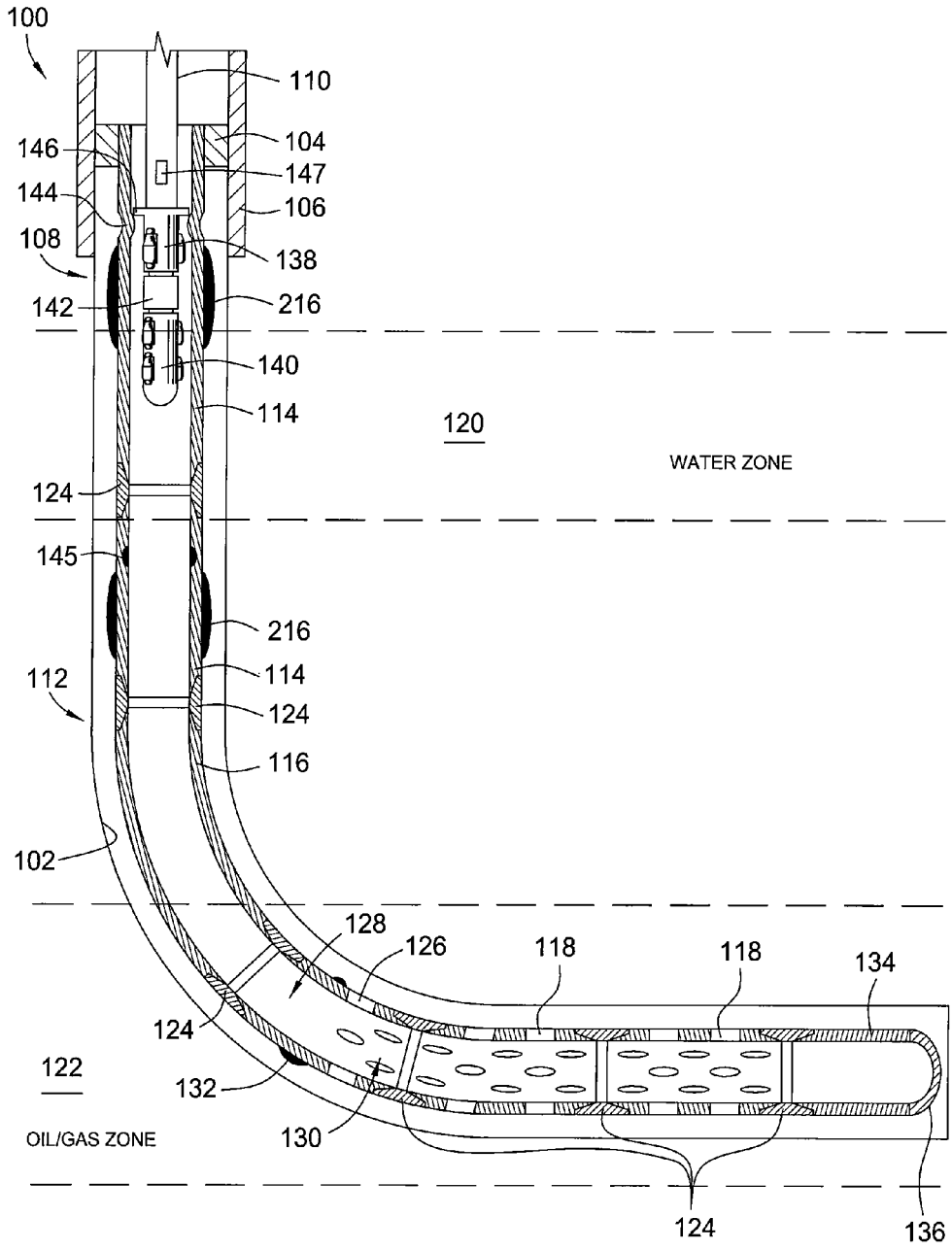
FIG. 1 is a partial section view of an isolation system having an expansion assembly and a tubular string, which is unexpanded and hung from a lower end of casing in a wellbore.

FIG. 1 illustrates a partial section view of an isolation system 100 disposed within a borehole 102 and secured by a conventional liner hanger 104 to a lower end of casing 106. The isolation system 100 includes an expansion assembly 108 at the lower end of a work string or running string 110 and a tubular string 112 made up of joints of expandable zone isolation (EZI) units 114, solid liner 116 and expandable sand screen (ESS) members 118. Arrangement of the EZI units 114, the solid liner 116 and the ESS members 118 in the desired sequence and number during makeup of the tubular string 112 determines which preselected portions of the borehole 102 that each joint respectively traverses when the tubular string 112 is positioned in the borehole 102. As such, the tubular string 112 may not include any of the solid liner 116. The system 100 enables fluid isolation of zones such as a water zone 120 from an oil/gas zone 122 due to the arrangement of joints within the tubular string 112. Generally, the zones to be isolated with the system 100 may include multiple zones with different fluids and/or multiple zones at different pressures depending upon the specific application. The EZI units are expandable solid tubular members capable of forming a seal with the borehole 102 when expanded. Thus, the EZI units 114 to be expanded to seal the annulus between the borehole 102 and the tubular string 112 span the water zone 120 to be isolated, and the ESS members 118 traverse at least a portion of the oil/gas zone 122. While the EZI units 114 traversing the water zone 114 are shown as only two joints, additional EZI units and/or solid liner may be disposed between the EZI units 114 depending on the length of the water zone 120.

The joints, whether the EZI unit 114, the solid liner 116 or the ESS member 118, of the tubular string 112 may couple to one another in any conventional manner since the connections are not required to be expanded with the system 100 disclosed herein. For example, the joints may couple to one another by non-expandable solid connectors 124, standard pin-box connections at the ends of each joint or welding. Furthermore, each of the ESS members 118 can have solid connection areas at each end thereof for threading with the solid connectors 124, thereby improving mechanical characteristics of the connection, such as tensile strength and torque resistance of the connections between the ESS members 118. In alternative embodiments, some or all of the connections between joints in the tubular string 112 are expanded. Examples of suitable expandable connections are disclosed in U.S. Pat. Nos. 6,722,443; 6,767,035; and 6,685,236 and U.S. patent application Ser. Nos. 10/741,418; 10/613,341; 10/670,133; 09/381,508; 10/664,584; 10/663,351; 10/313,920; 10/443,664; 10/408,748; and 10/455,655, which are all incorporated herein by reference.

Referring still to FIG. 1, the tubular string 112 may additionally include a hybrid tubular 126 coupled to a first joint of the ESS members 118. The hybrid tubular 126 includes an upper solid portion 128 and a lower perforated or slotted portion 130. In situations where the hybrid tubular is connected to the ESS members below an oil/gas zone, the upper portion would be slotted and the lower portion would be solid. Both the upper solid portion 128 and the lower slotted portion 130 are expanded during operation of the system 100. Thus, the hybrid tubular 126 enables continuous expansion between the interface between the solid and slotted portions 128, 130 without requiring expansion of a connection between tubulars. Alternatively, either the upper solid portion 128 or the lower slotted portion 130 may be expanded without expanding both portions 128, 130. The upper solid portion 128 may include a sealing material 132 such as lead, rubber or epoxy on an external surface of the hybrid tubular 126. Preferably, rubber seals are bonded to, or injection molded, to the external surface of the hybrid tubular 126 to provide the sealing material 132. Alternatively, the upper solid portion may include an external profile to engage the borehole 102 and/or an outer surface that forms a micro annulus when expanded against the borehole 102 to provide a labyrinth seal. Therefore, the hybrid tubular 126 may replace or be used in combination with a lower one of the EZI units 114 disposed below the water zone 120.

In a preferred embodiment, each of the ESS members 118 include a base pipe with axially overlapping slots surrounded by one or more layers of mesh or weave and an outer perforated shroud disposed around an exterior thereof. However, the ESS member 118 may be any perforated tubular, slotted tubular or commercially available screen and may not even provide sand exclusion. A last one of the ESS members 118 preferably couples to a solid pipe end member 134, which couples to a guide nose 136 at the end of the tubular string 112. The solid pipe end member 134 provides integrity to the end of the tubular string 112 during lowering of the tubular string 112, and a coned end of the guide nose 136 directs the tubular string 112 through the borehole 102 as the tubular string 112 is lowered. In alternative embodiments, the isolation system 100 ends with the last EZI unit 114 and/or hybrid tubular 126 leaving the well as an open hole well.

The expansion assembly 108 of the system 100 includes an EZI expander 138, an ESS expander 140 and an expander selection mechanism such as a diverter valve 142 disposed between the EZI expander 138 and the ESS expander 140. As shown in FIG. 1, the running string 110 releases from the tubular string 112 upon running the tubular string 112 into the borehole 102 and setting the liner hanger 104 such that further lowering of the running string 110 through the tubular string 112 positions the expansion assembly 108 proximate a first desired location for expansion. A tag 144 along the inside diameter of the EZI unit 114 identifies the first desired location for expansion by interfering with a mating tag locator 146 disposed on a top portion of the EZI expander 138. While a lower portion of the expansion assembly 108 passes through the tag 144 when the expanders 138, 140 are not actuated, the interference between the tag 144 and tag locator 146 prevents further passage and lowering of the running string 110.

The tag 144 may be any restriction along the inside diameter of a tubular such as the EZI unit 114 in order to accurately identify a depth/location for expansion. Preferably, a machined section of tubular coupled (e.g., welded) to another tubular section of the EZI unit 114 that is to expanded forms the tag 144. Alternatively, the tag 144 may include an annular crimp in the wall of the EZI unit 114, a weld bead on an inside surface of the EZI unit 114, a ring affixed to the inside surface or a salt bag disposed on the inside surface.

FIG. 1 also shows an alternative embodiment for identifying the location where expansion of a wellbore tubular is desired to begin and/or end. In this embodiment, a battery (not shown) operates a radio frequency transmitter and receiver 147 coupled to the expansion assembly 108, and a radio frequency identification device (RFID) such as a passive RFID 145 is disposed on the tubular to be expanded such as the EZI unit 114. The location of the passive RFID 145 on the EZI unit 114 identifies where expansion is desired to begin. In operation, the transmitter and receiver 147 transmits a signal at the appropriate frequency to excite the passive RFID 145. The transmitter and receiver 147 receives a response signal from the passive RFID 145 only when in close enough proximity that the transmitted signal can be detected and responded to and the response signal can be received. Upon receipt of the response signal, the transmitter and receiver 147 sends an actuation signal to an operator that actuates the expander assembly 108 accordingly. Alternatively, the transmitter and receiver 147 may send an actuation signal directly to an expansion tool in order to actuate the expansion tool.

Figure 2:
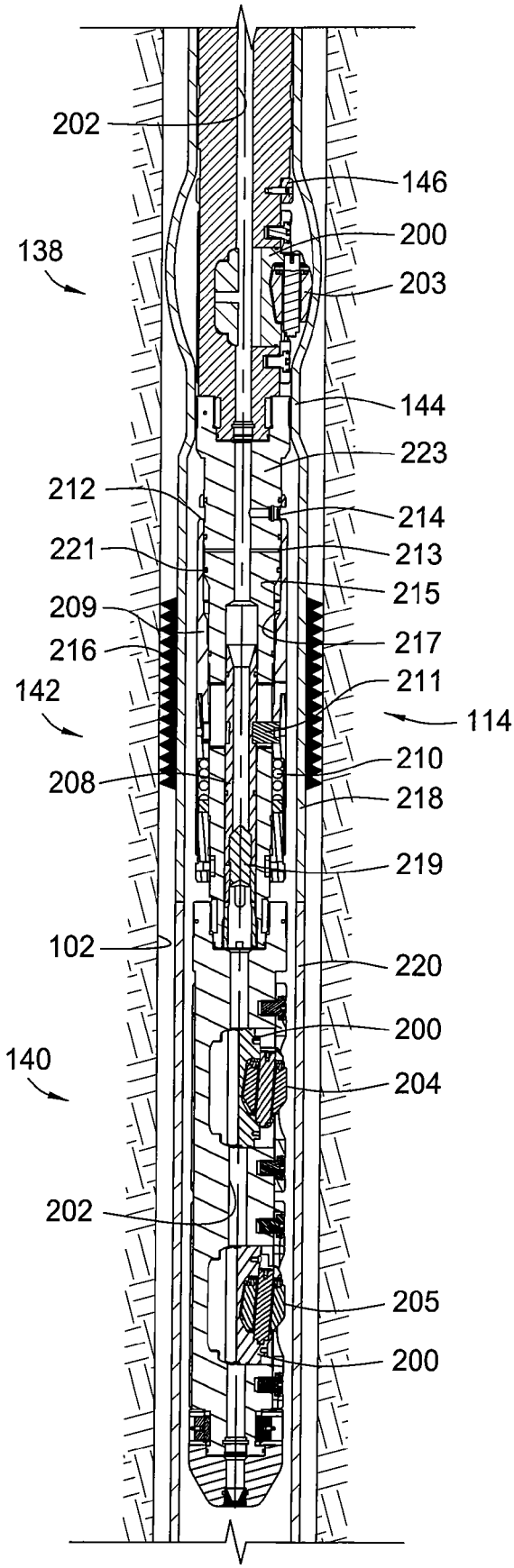
FIG. 2 is an enlarged section view of an expandable zone isolation (EZI) unit within the tubular string and an EZI expander of the expansion assembly activated inside the EZI unit.

FIG. 2 shows the EZI expander 138 actuated inside one of the EZI units 114 in order to expand a length of the EZI unit 114. U.S. Pat. No. 6,457,532, which is hereby incorporated by reference, describes in detail an example of a rotary expander such as the ESS expander 140 and the EZI expander 138 of the system 100. In general, the expanders 138, 140 include a plurality of radially slidable pistons 200 radially offset at circumferential separations. Exposure of the backside of each piston 200 to pressurized fluid within a hollow bore 202 of the expanders 138, 140 actuates the pistons 200 and causes them to extend outward. Disposed above each piston 200 are rollers 203, 204, 205.

Prior to actuation of the EZI expander 138, raising the running string 110 by a predetermined distance such as a couple of feet positions the rollers 203 of the EZI expander 138 at or above the tag 144. Thus, the EZI expander 138 expands the tag 144 as the EZI expander 138 moves through the EZI unit 114. Once the tag 144 is expanded, the tag locator 146 can pass beyond the tag 144 enabling expansion of the rest of the EZI unit 114 and/or other tubulars located lower in the tubular string 112.

During expansion of the EZI unit 114, the ESS expander 140 remains deactivated since fluid flow through the bore 202 diverts to an annulus between the EZI unit 114 and the diverter valve 142 prior to the fluid reaching the ESS expander 140. While any diverter valve may be used to divert the fluid from reaching the ESS expander 140 based on differences in flow rate through the bore 202, the diverter valve shown in FIG. 2 includes a body 223 and an internal sliding sleeve 208 connected by keys 211 to an external sliding sleeve 209 that is biased by a spring 210. When the EZI expander is actuated, increased fluid flow increases the pressure of the fluid that acts on a first annular piston surface 215 formed on the inside of the external sliding sleeve 209 due to ports 213 through the body 223 to the bore 202. As the first annular piston surface 215 of the external sliding sleeve 209 moves relative to the body 223, a seal such as an o-ring 221 de-energizes and permits fluid to pass to a second annular piston surface 217 formed on the inside diameter of the external sliding sleeve 209, thereby increasing the overall piston area acted on to move the diverter valve 142 to a diverted position and providing the necessary additional force to close the fluid path through the bore 202. Moving the diverter valve 142 to the diverted position moves the external sliding sleeve 209 against the bias of the spring 210 and aligns apertures 212 in the external sliding sleeve 209 with flow through ports 214 extending through the body 223 to the bore 202. Additionally, a closing member 219 engages the internal sliding sleeve 208 to block further fluid flow through the bore 202 when the diverter valve 142 is in the diverted position. Thus, the diverter valve 142 in the diverted position directs flow through the flow through ports 214 that are open to the annulus between the EZI unit 114 and the diverter valve 142.

An external surface of the EZI unit 114 may include a sealing material 216 such as lead, rubber or epoxy. The sealing material 216 prevents the passage of fluids and other materials within the annular region between the EZI unit 114 and the borehole 102 after the EZI unit 114 is expanded to place the sealing material 216 into contact with the borehole 102. Preferably, one or more elastomer seals are bonded to, or injection molded, to the external surface of the EZI unit 114 to provide the sealing material 132. The sealing material 216 may include a center portion with a different hardness elastomer than end portions of the sealing material 216 and may further have profiles formed along an outside surface in order to improve sealing with the borehole 102.

The actual tubular body of the EZI unit 114 may additionally include an upper section 218 where the tag 144 and the sealing material 216 are located and a lower section 220. If the upper and lower sections 218, 220 are present, the upper section 218 is made from a material that is more ductile than a material from which the lower section 220 is made. A weld may couple the upper and lower sections 218, 220 together. Lowering and rotating of the running string 110 with the EZI expander 138 actuated expands a length of the EZI unit 114 along the upper section 218. The distance that the EZI expander 138 travels can be measured to ensure that only the EZI unit 114 is expanded and connections or connectors 124 (shown in FIG. 1) between joints are not expanded. As an alternative to measuring the distance traversed or to confirm the measurement, changes noticed relating to the expansion process can identify that the EZI expander 138 has completed expansion of the upper section 218 having the sealing material 216 thereon since expansion becomes more difficult and the rate of travel of the EZI expander 138 decreases once the EZI expander 138 reaches the lower section 220. Thus, the tag 144 effectively identifies a start point where expansion is desired while the lower section 220 effectively identifies an end point for expansion. The tag 144, the sections 218, 220 having different material properties and the RFID devices provide examples of positive downhole markers. Thus, the positive downhole markers ensure that correct portions of downhole tubulars or combinations of downhole tubulars are expanded. Further, expanding operations that utilize the positive downhole markers can occur without expanding connections or connectors 124 between the downhole tubulars.

Fluid flow through the bore 202 to the EZI expander 138 is stopped once the EZI expander reaches the lower section 220 of the EZI unit 114, thereby deactivating the expansion assembly 108. The expansion assembly 108 is then lowered to the next location where expansion is desired as may be marked by another downhole marker such as the passive RFID 145 (visible in FIG. 1) and expansion is commenced as described above. Once the EZI units 114 on each side of the water zone 120 are expanded, fluid and other material from the water zone 120 can not pass into an interior of the tubular string 112 since all the walls of the joints traversing the water zone 120 are solid. Additionally, fluid and other material from the water zone 120 can not pass to other regions of the annulus between the tubular string 112 and the borehole 102 since the seals 216 block fluid flow. In this manner, the system 100 isolates the water zone 120.

Figure 3:
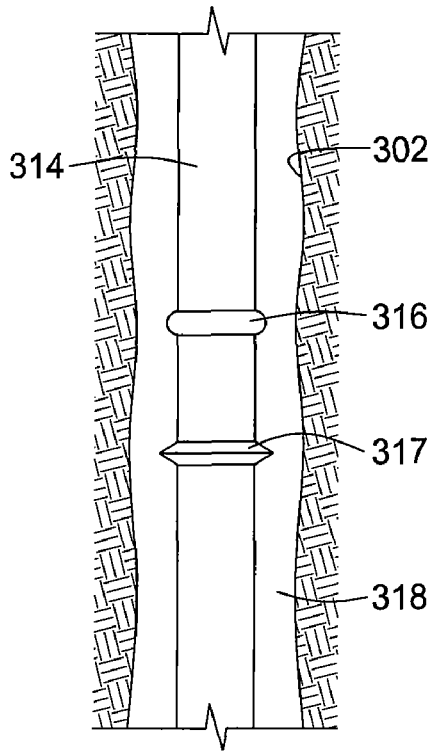
FIG. 3 is a view of a portion of an alternative EZI unit that includes a profile for engagement with a surrounding formation upon expansion thereof.

FIG. 3 illustrates a portion of an alternative EZI unit 314 that includes a bump profile 316 and an edge profile 317. The bump profile 316 engages with a surrounding formation within a borehole 302 when the EZI unit 314 expands, and the edge profile 317 penetrates into the formation when the EZI unit 314 expands. Thus, the edge and bump profiles 316, 317 seal an annulus 318 between the EZI unit 314 and the borehole 302 upon expansion of the EZI unit 314. The edge and bump profiles 316, 317 may be an integral part of the EZI unit 314 or a separate ring of metal or other hard material affixed to the exterior of the EZI unit 314. The EZI unit 314 may include any number and combination of the bump and edge profiles 316, 317.

Figure 4:
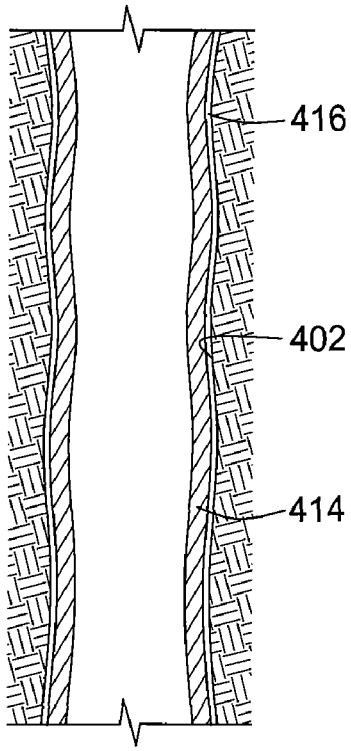
FIG. 4 is a section view of a portion of another alternative EZI unit after expansion thereof against a formation to provide a labyrinth seal.

FIG. 4 shows a portion of another alternative EZI unit 414 after expansion thereof against a formation to provide a labyrinth seal 416 defined by a micro annulus between the EZI unit 414 and a borehole 402. Like the sealing material 216 and the profiles 316, 317 described above, the labyrinth seal 416 prevents flow through the annulus between the EZI unit 414 and the borehole 402. Using an expansion tool such as a rotary expander described herein that is capable of compliantly expanding the EZI unit 414 enables formation of the labyrinth seal 416. The various sealing arrangements disclosed may be used in any combination. For example, the profiles 316, 317 shown in FIG. 3 may be used in combination with the labyrinth seal 416 shown in FIG. 4 and/or the sealing material 216 shown in FIG. 2.

Referring back to the system 100 shown in FIG. 1, fluid flow once again is stopped to the expansion assembly 108 once all the EZI units 114 (and the hybrid tubular 126 if present) above the ESS members 118 have been expanded. Then, the expansion assembly is lowered a given distance proximate the first joint of the ESS members 118. The distance may be determined by a tally or another downhole marker (not shown) such as described with the EZI units 114.

Figure 5:
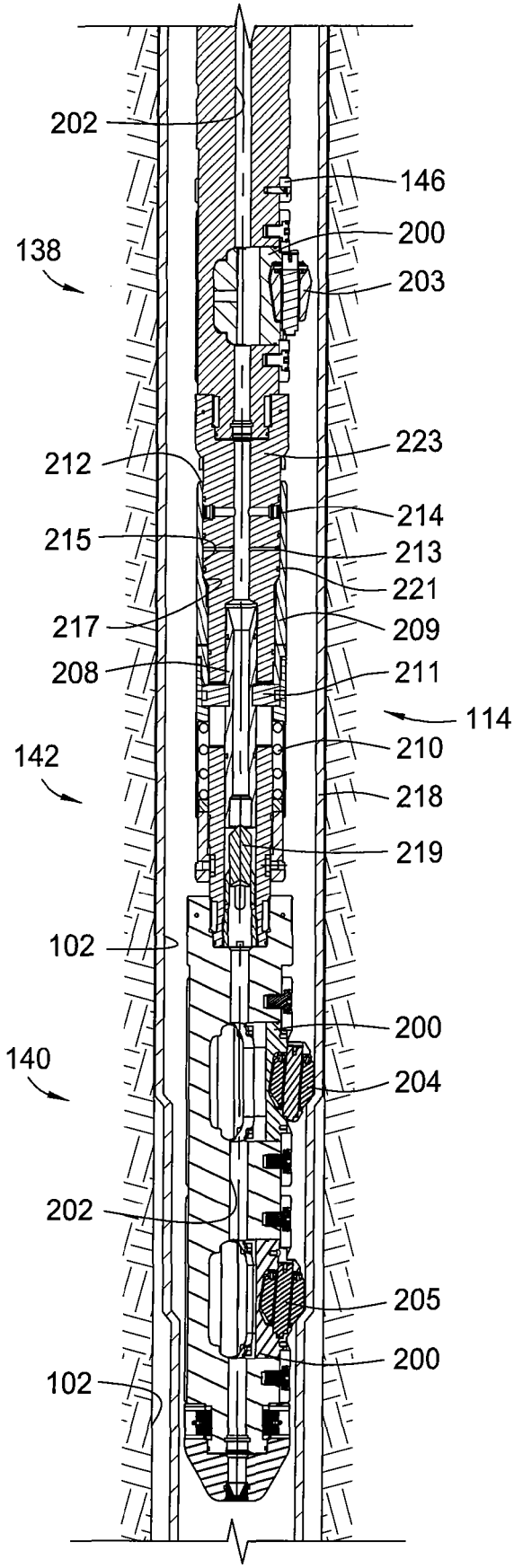
FIG. 5 is an enlarged section view of an expandable sand screen (ESS) member within the tubular string and an ESS expander of the expansion assembly activated and moved within the ESS member.

FIG. 5 illustrates the ESS expander 140 actuated inside one of the ESS members 118 and moved within the ESS member 118 in order to expand a length of the ESS member 118. The ESS member 118 may contact the formation to further support the borehole 102 once expanded. To actuate the ESS expander 140, fluid flow through the bore 202 is at a different flow rate compared to operations where it is desired to only actuate the EZI expander 138 and not the ESS expander 140. The spring 210 biases the sliding sleeves 208, 209 of the diverter valve 142 upward at a reduced flow rate, thereby closing the fluid passage to the flow through ports 214 and opening a fluid passage through the bore 202. The EZI expander 138 does not expand the ESS member 118 even though the EZI expander 138 may be actuated at the different flow rate since the ESS member 118 is already expanded by the ESS expander 140 located ahead of the EZI expander 138 by the time that the EZI expander 138 passes through the ESS member 118.

One feature making the ESS expander 140 especially adapted for expansion of the ESS members 118 may involve the use of a staged expansion to reduce weave stresses of the ESS members 118. Thus, a leading set of rollers 205 expands the ESS member 118 to a first diameter and a lagging set of rollers 204 completes expansion of the ESS member 118 to a final diameter. Additionally, the ESS expander 140 may not apply as much force as the EZI expander 138 even though at least the lagging set of rollers 204 extend to a greater diameter than the rollers 203 of the EZI expander 138.

In one embodiment, fluid flow to the expansion assembly 108 is stopped at the end of each of the ESS members 118 such that the connections or connectors 124 (shown in FIG. 1) are not expanded as the expansion assembly is lowered to subsequent ESS members for expansion. Alternatively, the expansion assembly 108 may not provide sufficient force to expand the connectors 124 when operated at the different flow rate used to actuate the ESS expander 140 such that the connectors 124 are not expanded even without stopping flow to the expansion assembly 108. In still other embodiments, the connections between the ESS members 118 are expanded.

Figure 6:
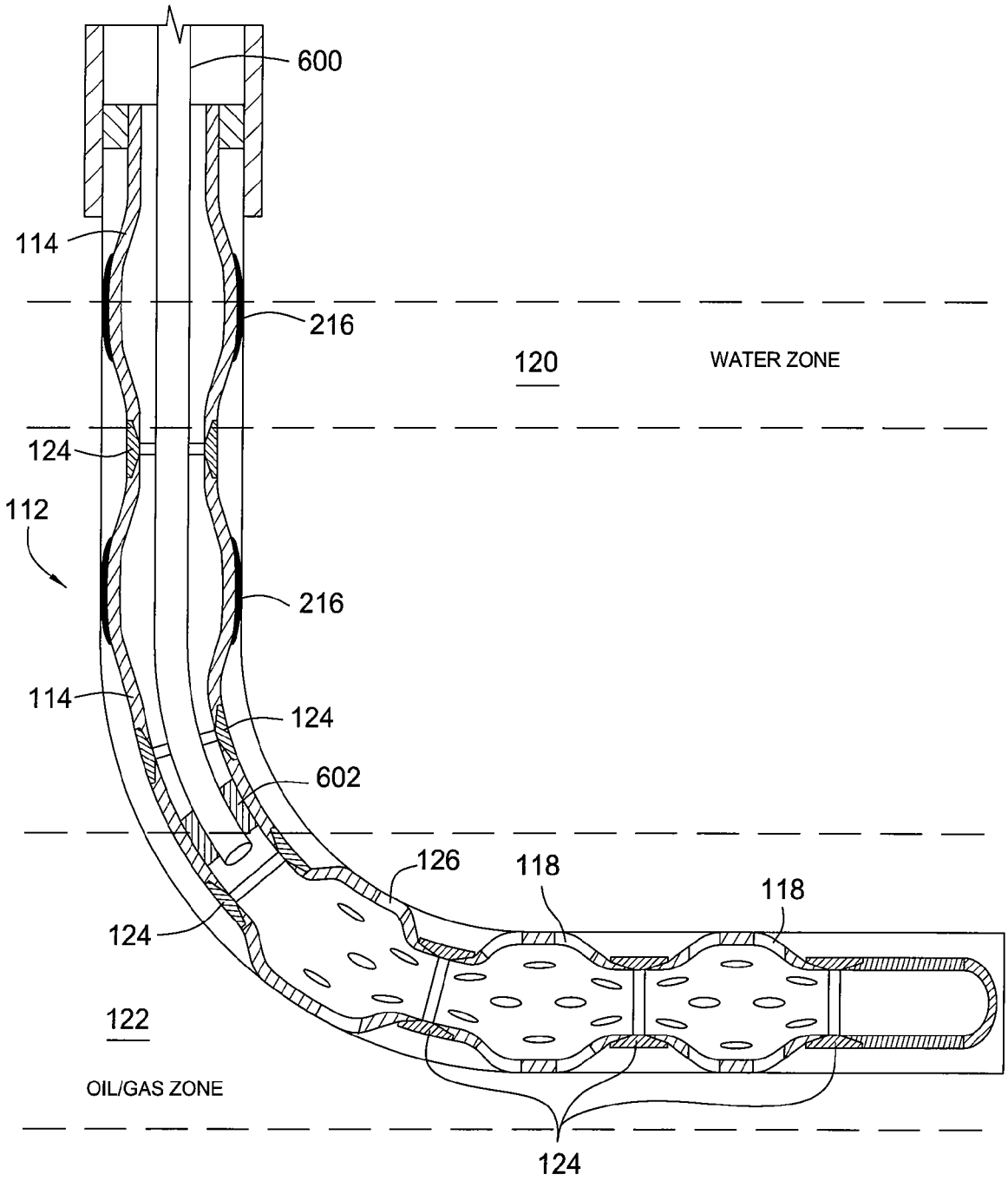
FIG. 6 is a partial section view of the tubular string in FIG. 1 after expansion thereof and insertion of a production tubing.

FIG. 6 shows the tubular string 112 in FIG. 1 after expansion thereof and insertion of a production tubing 600. The production tubing 600 includes a packer 602 seated within a portion of the tubular string 112 that is not expanded. Thus, the production tubing 600 provides a fluid path to the surface for flow from the ESS members 118 when the production tubing 600 is present. The production tubing 600 may include sliding sleeves (not shown) to further select and control production from the oil/gas zone 122. Additional EZI members disposed within the tubular string 112 may isolate any additional non-productive zones such as the water zone 120, and additional ESS members may be disposed within the tubular string 112 at any additional oil/gas zones. When multiple oil/gas zones are present, a packer such as the packer 602 may be positioned between the ESS members 118 and the additional ESS members in order to enable separation and control of production from the various oil/gas zones.

While the expansion process of the tubular string 112 described above occurs in a top-down manner using the ESS expander 140 and the EZI expander 138, a similar bottom-up expansion process may incorporate the various aspects disclosed herein. Furthermore, alternative embodiments of the invention utilize an expansion assembly having other combinations of expander tools known in the industry for expanding solid tubulars and perforated or slotted tubulars. For example, U.S. patent application Ser. Nos. 10/808,249 and 10/470,393, which are incorporated herein by reference, describe expandable expanders that may be used as the expansion assembly.

Figure 7:
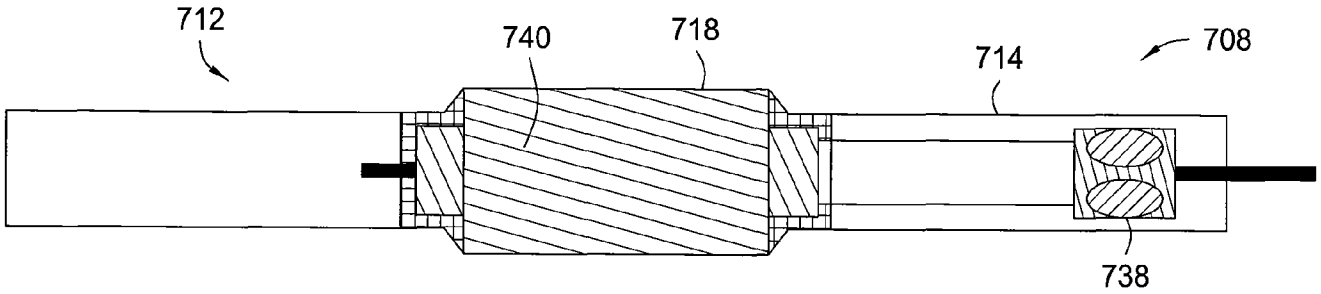
FIG. 7 is a partial section view of a tubular string after expanding an ESS member with an inflatable element of an alternative expansion assembly and prior to expansion of an EZI unit with a rotary expander of the expansion assembly.

FIG. 7 illustrates a tubular string 712 after expanding an ESS member 718 with an inflatable element 740 of an alternative expansion assembly 708 and prior to expansion of an EZI unit 714 with a rotary expander 738 of the expansion assembly 708. The inflatable element 740 may be a packer used to expand a tubular as disclosed in U.S. Pat. No. 6,742,598, which is herein incorporated by reference in its entirety. In another example, an expandable cone may be used to expand perforated or slotted tubulars disposed within a tubular string and a rotary expander may be used to expand solid tubulars disposed within the tubular string.

Figure 8:
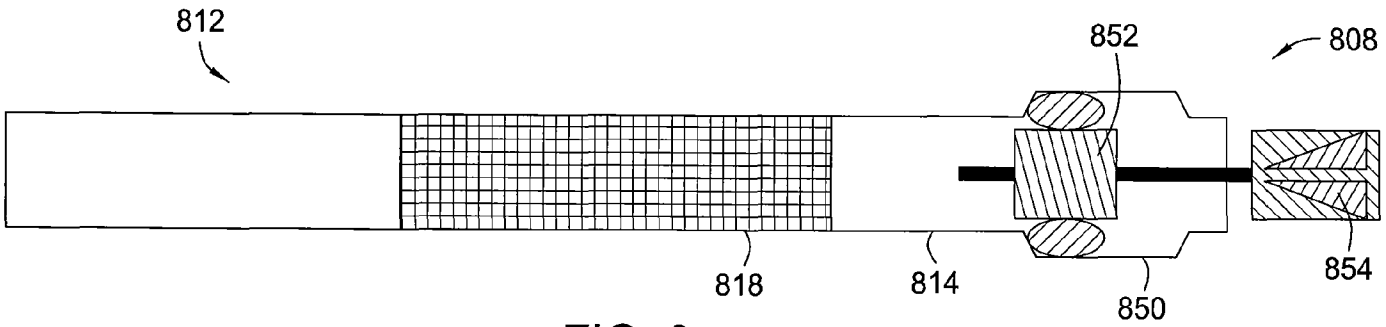
FIG. 8 is a partial section view of a tubular string after expanding a garage portion of an EZI unit with a rotary expander of another alternative expansion assembly.
Figure 9:
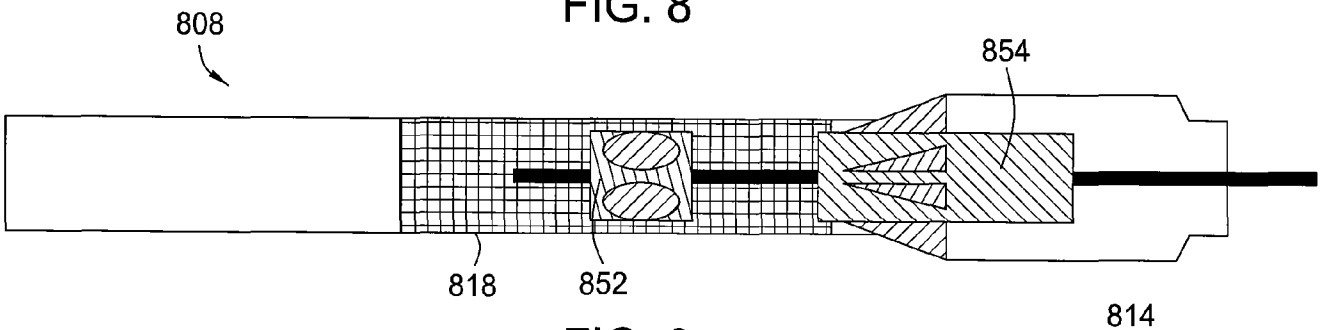
FIG. 9 is a partial section view of the tubular string shown in FIG. 8 after actuating an expandable cone of the expansion assembly in the garage portion and moving the expandable cone within the EZI unit.

FIG. 8 shows a tubular string 812 after expanding a garage portion 850 of an EZI unit 814 with a rotary expander 852 of another alternative expansion assembly 808. The garage portion 850 provides an expanded section of the EZI unit 814 where an expandable cone 854 can be actuated to an expanded position without having to expand the EZI unit 814. Alternatively, the garage portion 850 may be formed by an inflatable element. FIG. 9 illustrates the tubular string 812 shown in FIG. 8 after actuating the expandable cone 854 of the expansion assembly 808 in the garage portion and moving the expandable cone 854 within the EZI unit 814 in order to complete expansion of the EZI unit 814. An ESS member 818 disposed within the tubular string 812 may be expanded by the rotary expander 852 alone, the expandable cone 854 alone or by the rotary expander 852 and the expandable cone 854 in combination, as with the EZI unit 814. U.S. patent application Ser. No. 10/808,249, which is incorporated herein by reference, describes a similar expansion process.

In yet a further alternative embodiment, the ESS expander 140 of the system 100 illustrated in FIG. 1 is disposed behind the EZI expander 138 and remains on when the EZI expander 138 is supplied with pressurized fluid during the expansion of the EZI units 114. However, the ESS expander 140 does not expand the EZI units 114 since the ESS expander 140 can be designed to not apply sufficient force to expand a solid tubular member such as the EZI units 140. For example, limiting the piston area that radially moves the rollers 204, 205 (shown in FIGS. 2 and 5) of the ESS expander 140 outwards limits the force that the ESS expander 140 can apply. The EZI expander 138 can be selectively turned off by the expander selection mechanism such as the diverter valve 142 when the ESS expander 140 is used to expand the ESS members 118 or the slotted portion 130 of the hybrid tubular 126 such that the EZI expander 138 does not harm the ESS members 118 or the slotted portion 130. Any downhole marker along the tubular string 112 may be used to identify the desired locations for turning the EZI expander 130 off and/or on.

As described herein, an expansion assembly such as the expansion assemblies 108, 708, 808 shown in FIGS. 1, 7 and 8 may be selected to include any combination of a first expander having a first expansion mode and a second expander having a second expansion mode. The first and second expanders may be operatively connected to provide the expansion assembly that is run into the wellbore as a unit in a single trip. The term "expansion mode" as used herein refers broadly to a characteristic of the expander such as a force capable of being supplied by the expander during expansion, a type of expander (e.g., rotary expander, expandable cone, packer or inflatable element), and a diameter of the expander for staging expansion and/or selecting a final diameter upon expansion.

A method for isolating a subterranean zone includes making up a tubular string at the surface, coupling the tubular string to a liner hanger with the expansion assembly stabbed therein to provide a system, running the system into the borehole to depth, setting the liner hanger, releasing the running string from the liner hanger, running into the tubular string until a mating tag on the expansion assembly contacts a tag in a tubular, raising the expansion assembly a predetermined distance prior to expanding, expanding a length of the tubular including the tag to permit the mating tag to pass through the tag upon expansion thereof and stopping expanding upon reaching a section of the tubular made from a less ductile material than the length of the tubular. In one embodiment, a method includes locating a tubular string in a borehole, wherein the tubular string includes a first expandable zone isolation unit disposed on a first side of a zone to be isolated, a second expandable zone isolation unit disposed on a second side of the zone to be isolated, and a perforated tubular disposed in fluid communication with a producing zone, expanding middle portions of the first and second expandable zone isolation units while leaving the ends of the first and second expandable zone isolation units unexpanded, expanding a middle portion of the perforated tubular while leaving the ends of the perforated tubular unexpanded.

While the foregoing is directed to embodiments of the present invention, other and further embodiments of the invention may be devised without departing from the basic scope thereof, and the scope thereof is determined by the claims that follow.

The invention claimed is:

1. An expansion assembly for expanding a tubular, comprising:

a first expander;

a second expander, wherein the first and second expanders are operatively connected to circumferentially expand the tubular; and a valve located between the first and second expanders, wherein the valve is selectively operable using fluid pressure to control fluid communication between the first expander and the second expander, wherein the valve is operable to open fluid communication between the first and second expanders at a first fluid flow rate and operable to close fluid communication between the first and second expanders at a second fluid flow rate that is different than the first fluid flow rate.

2. The assembly of claim 1, wherein the first and second expanders are configured to apply different expansion forces to the tubular.

3. The assembly of claim 1, wherein the first and second expanders are selectively actuatable.

4. The assembly of claim 1, wherein the first expander is a rotary expander and the second expander is a cone.

5. The assembly of claim 1, wherein at least one of the expanders is a packer.

6. The assembly of claim 1, wherein the valve includes a body having a bore disposed therethrough to provide fluid communication between the first and second expanders, and one or more ports disposed through the body to provide fluid communication between the bore and an annulus surrounding the body.

7. The assembly of claim 6, wherein the valve further includes a sleeve that is selectively operable to open and close fluid communication through the ports between the bore of the body and the annulus surrounding the body.

8. The assembly of claim 7, wherein the valve further includes a biasing member operable to bias the sleeve into a closed position to close fluid communication through the ports.

9. The assembly of claim 8, wherein the valve further includes a stop member operable to close fluid communication through the bore of the body when the sleeve is positioned in an open position to open fluid communication through the ports.

10. The assembly of claim 1, wherein the valve include includes a body, an internal sleeve disposed inside the body, and an external sleeve disposed outside the body, wherein the internal and external sleeves are coupled together and operable to open and close fluid communication through the body.

11. The assembly of claim 10, wherein the internal sleeve is operable to open and close fluid communication through a bore of the body that provides fluid communication between the first and second expanders.

12. The assembly of claim 11, wherein the external sleeve is operable to open and close fluid communication through one or more ports of the body that provide fluid communication between the bore of the body and an annulus surrounding the body.

13. The assembly of claim 12, wherein the valve further includes a biasing member operable to bias the external sleeve into a closed position, thereby closing fluid communication through the one or more ports between the bore of the body and the annulus surrounding the body.

14. The assembly of claim 13, wherein the valve further includes a closing member operable to engage the internal sleeve, thereby closing fluid communication through the bore of the body.

15. The assembly of claim 10, wherein the internal and external sleeves are movable relative to the body by applying fluid pressure against a piston surface of at least one of the internal and external sleeves.

16. The assembly of claim 10, wherein the external sleeve includes a piston surface that is pressure actuated to move the external sleeve relative to the body to open one or more ports of the body that provide fluid communication between a bore of the body and an annulus surrounding the body.

17. The assembly of claim 1, wherein at least one of the first and second expanders is a pressure actuated mechanical expander.

18. The assembly of claim 1, wherein the first fluid flow rate is less than the second fluid flow rate.

19. The assembly of claim 1, wherein the first and second expanders include a plurality of radially slideable pistons, and wherein the radially slideable pistons of the first expander include a piston area sized to limit a force for a given fluid pressure that the first expander can apply to the tubular relative to the second expander.

20. The assembly of claim 19, wherein the first and second expanders are configured to apply different expansion forces to the tubular.

21. An expansion assembly, comprising:

an upper expander;

a lower expander; and a valve coupled to the upper and lower expanders, wherein the valve is operable to open fluid communication between the upper and lower expander at a first fluid pressure and operable to close fluid communication between the upper and the lower expander at a second fluid pressure that is greater than the first fluid pressure.

22. The assembly of claim 21, wherein the valve comprises:

a body having a flow path to provide fluid communication between the upper and lower expanders;

a first sleeve disposed in the flow path; and a biasing member operable to bias the first sleeve into an open position to open fluid communication through the flow path.

23. The assembly of claim 22, wherein the valve further includes a closing member disposed in the flow path, wherein the first sleeve is operable to engage the closing member and close fluid communication through the flow path.

24. The assembly of claim 23, wherein the valve further includes a second sleeve coupled to the body and configured to control fluid communication through one or more ports disposed through the body from the flow path to the annulus surrounding the body.

25. A method of expanding a tubular using an expansion assembly, comprising:

flowing fluid at a first flow rate through the expansion assembly, wherein the expansion assembly includes an upper expander in selective fluid communication with a lower expander;

expanding a first portion of the tubular using the lower expander;

flowing fluid at a second flow rate through the expansion assembly; and expanding a second portion of the tubular using the upper expander.

26. The method of claim 25, wherein the first flow rate is less than the second flow rate.

27. The method of claim 25, wherein expanding the first portion of the tubular includes using the first flow rate to actuate the lower expander.

28. The method of claim 25, wherein expanding the second portion of the tubular includes using the second flow rate to actuate the upper expander.

29. The method of claim 25, further comprising moving the expansion assembly through the tubular from the first portion to the second portion, after expansion of the first portion of the tubular and before expansion of the second portion of the tubular, and without expanding a portion of the tubular located between the first and second portions.

30. The method of claim 25, further comprising closing fluid communication between the upper expander and the lower expander using the second flow rate.

31. The method of claim 25, further comprising controlling fluid communication between the upper expander and the lower expander using a selectively actuatable valve located between the upper and lower expanders.

32. The method of claim 25, wherein the expansion assembly includes a valve located between the upper and lower expanders, wherein the valve is operable to control fluid communication between the upper and lower expanders.

33. The method of claim 32, further comprising closing the valve by flowing fluid at the second flow rate through the expansion assembly, thereby closing fluid communication to the lower expander.

34. The method of claim 32, further comprising applying fluid pressure against a piston surface of the valve using the second flow rate to move the valve into a closed position, thereby closing fluid communication to the lower expander.

35. The method of claim 32, further comprising biasing the valve into an open position while flowing fluid through the expansion assembly at the first flow rate, thereby opening fluid communication to the lower expander.

36. The method of claim 32, further comprising diverting fluid to an annulus surrounding the expansion assembly using the valve while flowing the fluid at the second flow rate and actuating the upper expander to expand the second portion of the tubular.

37. The method of claim 25, further comprising expanding the first portion of the tubular using the lower expander while flowing fluid at the first flow rate through the expansion assembly, and increasing fluid flow through the expansion assembly to the second flow rate, thereby expanding the second portion of the tubular using the upper expander and closing fluid communication to the lower expander to deactivate the lower expander.

* * * * *

UNITED STATES PATENT AND TRADEMARK OFFICE

CERTIFICATE OF CORRECTION

PATENT NO. : 8,006,771 B2
APPLICATION NO. : 12/467103
DATED : August 30, 2011
INVENTOR(S) : Green et al.

It is certified that error appears in the above-identified patent and that said Letters Patent is hereby corrected as shown below:

On the Title Pg, in Related U.S. Application Data Item (60):

Line 15, please delete "which is" and insert --and-- therefor;

In Claims:

Column 10, Claim 10, Line 61, please delete "include".

Signed and Sealed this
Twenty-eighth Day of February, 2012

David J. Kappos

David J. Kappos
*Director of the United States Patent and Trademark Office*